US005363178A

United States Patent [19]

Matsumoto

[11] Patent Number: 5,363,178

[45] Date of Patent: Nov. 8, 1994

[54] IMAGE FORMING APPARATUS

[75] Inventor: Kenichi Matsumoto, Tokyo, Japan

[73] Assignee: Canon Kabushiki Kaisha, Tokyo, Japan

[21] Appl. No.: 958,490

[22] Filed: Oct. 8, 1992

Related U.S. Application Data

[63] Continuation of Ser. No. 632,624, Dec. 26, 1990, abandoned, which is a continuation of Ser. No. 505,999, Apr. 9, 1990, abandoned.

[30] Foreign Application Priority Data

Apr. 11, 1989 [JP] Japan ..... 1-091098

[51] Int. Cl.[5] ..... G03G 15/14

[52] U.S. Cl. ..... 355/273; 355/274; 355/327

[58] Field of Search ..... 355/272, 273, 281, 274, 355/246, 327; 118/645

[56] References Cited

U.S. PATENT DOCUMENTS

| | | | |
|---|---|---|---|
| 3,729,311 | 4/1973 | Langdon | 355/274 |
| 3,960,444 | 6/1976 | Gundlach et al. | 355/327 X |
| 4,093,457 | 6/1978 | Hauser et al. | 96/1.2 |
| 4,162,843 | 7/1979 | Inoue et al. | 355/274 X |
| 4,531,828 | 7/1985 | Hoshino | 355/272 X |
| 4,788,574 | 11/1988 | Matsumoto et al. | 355/326 |
| 4,916,492 | 4/1990 | Hoshika et al. | 355/253 |
| 4,931,839 | 6/1990 | Tompkins et al. | 355/327 X |
| 4,987,454 | 1/1991 | Natsuhara | 355/259 |

FOREIGN PATENT DOCUMENTS

| | | |
|---|---|---|
| 0275636 | 7/1988 | European Pat. Off. . |
| 0082263 | 5/1983 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus, particularly a color image forming apparatus. A conveyer belt made of dielectric material is charged-up electrically by repetitive image transfer actions using corona charging. By the charge-up the transfer current decreases with the result of decrease of image density. In order to compensate with this, the average charge amount of the toner particles transferred to the image receiving material at later stage or stages of the repetitive image transfer actions is decreased with respect to the average charge amount of the toner particles transferred onto the image receiving material in the initial stage or stages of the repetitive image transfer actions. By doing so, the toner image densities in the respective colors are made uniform, so that sharp images can be produced.

30 Claims, 2 Drawing Sheets

IMAGE FORMING APPARATUS

This application is a continuation of application Ser. No. 07/632,624 filed Dec. 26, 1990, now abandoned, which is a continuation of application Ser. No. 07/505,999 filed Apr. 9, 1990, now abandoned.

FIELD OF THE INVENTION AND RELATED ART

The present invention relates to an image forming apparatus wherein different color images are formed in an image forming station and are sequentially overlaid on the same transfer material.

In a color copying machine capable of forming a color image through a multi-color electrophotographic process, there are provided a plurality of image forming stations for forming visualized images (toner images) of different colors by the image forming stations, and the toner images are sequentially and superposedly transferred onto the same transfer material.

FIG. 4 shows an example of such an image forming apparatus. The apparatus comprises first, second, third and fourth image forming stations Pa, Pb, Pc and Pd. Each of the image forming stations has an image bearing member in the form of an electrophotographic photosensitive drum 1*a*, 1*b*, 1*c* or 1*d* therefor.

Around each of the photosensitive drums 1*a*, 1*b*, 1*c* and 1*d*, there are a latent image forming station 2*a*, 2*b*, 2*c* or 2*d*, a developing station 3*a*, 3*b*, 3*c* or 3*d*, an image transfer discharger 4*a*, 4*b*, 4*c* or 4*d* and a cleaning station 5*a*, 5*b*, 5*c* or 5*d*.

In operation, a latent image of a yellow component, for example, of an original is formed by the latent image forming station 2*a* on the photosensitive drum 1*a* of the first image forming station Pa. The latent image is developed into a visualized image with a developer having yellow developer in the developing station 3*a*, and the developed image is transferred onto the transfer material 6 in the transfer station 4*a*, the transfer material 6 having been fed by a conveyer belt 8 to the image transfer station where the transfer discharger and the photosensitive drum are faced to each other.

During the yellow image being transferred to the transfer material 6, the second image forming station Pb forms on the photosensitive drum 1*b* a latent image for the magenta color component. Subsequently, the latent image is developed into a visualized image with the developer containing the magenta toner in the developing station 3*b*. The visualized magenta toner image is overlaid at the correct position on the transfer material 6 when the transfer material 6 having the image already transferred by the first image forming station Pa comes to the next image transfer station 4*b*.

In the similar manner, the third and fourth image forming stations Pc and Pd form cyan color and black color images, and the cyan color and black color images are transferred on the same transfer material.

When such image forming process is completed, the transfer material 6 is conveyed to an image fixing station, where the images are fixed on the transfer material. Thus, a multi-color image is transferred on the transfer material 6. Each of the photosensitive drum 1*a*, 1*b*, 1*c* and 1*d* having been subjected to be image transfer station, is cleaned by the associated cleaning station 5*a*, 5*b*, 5*c* or 5*d*, by which the residual toner particles are removed therefrom to the prepared for the next latent image formation.

In such an image forming apparatus, a conveyer belt 8 is used to convey the transfer material 6. In FIG. 4, the transfer material 6 is conveyed from the right side to the left side. During the conveying, the transfer material 6 passes through the transfer stations 4*a*, 4*b*, 4*c* and 4*d* of the image forming stations Pa, Pb, Pc and Pd. In the transfer stations, transfer bias voltage is applied thereto. As for the material of the conveying means for conveying the transfer material 6, various proposals have been made from the standpoint of easy manufacturing and durability; such as Tetron in the form of a mesh, thin sheet of polyethyleneterephthalate resin, a thin sheet of polyimide resin, urethane resin or PVdF.

The inventor's experiments and investigations, however, have revealed that they involve problems.

The conveying belt of Tetron fibers in the form of a mesh has a drawback that the fibers constituting the mesh are easily deviated during the conveying process with the result of belt deformation. Therefore, the drive transmission efficiency in the belt conveying speed control system decreases, so that the correct conveying speed is not maintained. In addition, since the belt is in the form of a mesh, the close contactness of the transfer material thereto is not good with the result that the positional deviation occurs between the transfer material and the conveying belt due to the vibration of the conveying belt in operation. By the deviation and by the non-flatness of the surface of the conveying belt, non-uniform image transfer can be easily produced. Furthermore, since the size of the mesh is far larger than the particle size of the toner, the toner particles are scattered from the photosensitive drum to the transfer charger outside the contact transfer area in which the image should be transferred from the photosensitive drum to the transfer material in the image transfer process. Then, the toner particles pass through the mesh to contaminate the transfer charger with the toner particles.

The latter materials (dielectric sheet) have high tension elasticity, a high drive transmission efficiency in the belt drive control system, a generally high volume resistivity of not less than $10^{16}$ ohm.cm, and therefore, they are advantageous for electrostatically attracting the transfer material on the belt, substantially without the drawbacks in the mesh belt discussed above.

However, such a conveyer belt has such a high volume resistivity that the amount of electric charge on the conveyer belt increases during the repeated image transfer operations in the color image forming apparatus. Therefore, the uniform image transfer is not maintained unless the transfer currents are sequentially increased in the plural image transfer operations. This requires complicated and costly structure such as control means for the transfer current, with the result of an expensive device.

SUMMARY OF THE INVENTION

Accordingly, it is a principal object of the present invention to provide an image forming apparatus wherein the uniform image transfer operations are possible without increasing the transfer current for the sequential image transfer operations.

It is another object of the present invention to provide an image forming apparatus without complicated and expensive structure for the image transfer.

It is a further object of the present invention to provide an image forming apparatus capable of providing high quality images.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 3:
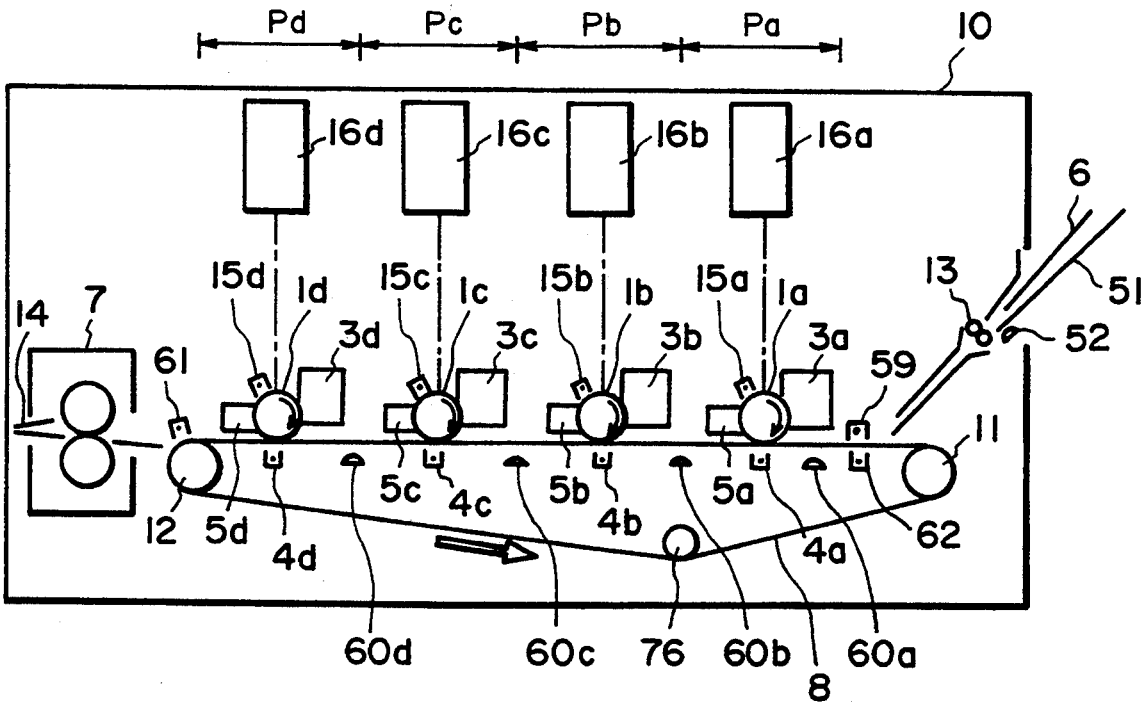
FIG. 3 is a sectional view of an image forming apparatus according to an embodiment of the present invention.
Figure 4:
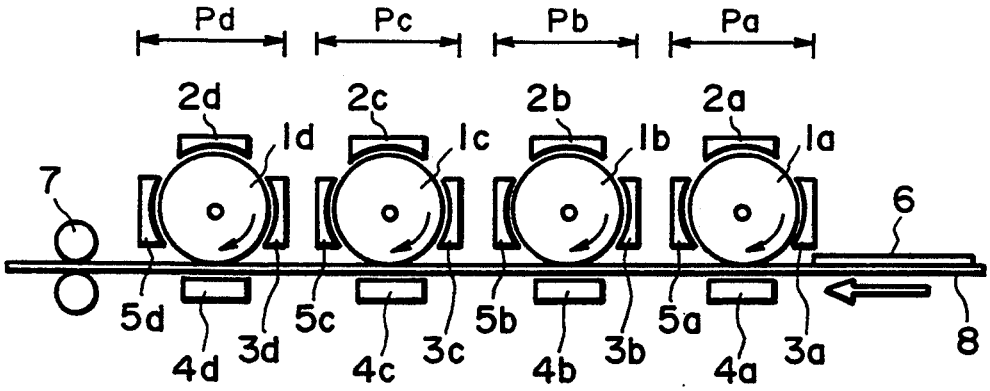
FIG. 4 is a sectional view of a conventional image forming apparatus.

Referring to FIG. 3, there is shown an image forming apparatus according to an embodiment of the present invention. The image forming apparatus comprises a main assembly 10 including image forming stations Pa, Pb, Pc and Pd. Below the image forming stations, there is transfer material conveying means having a belt 8, stretched around driving rollers 11, 12 and 76. The belt 8 is rotated in the direction indicated by an arrow. To the right side of the belt 8, there is disposed a sheet feeding mechanism 13, through which a transfer material 6 is supplied onto the belt 8. The transfer material 6 having been subjected to the image transfer operations in the image forming stations Pa, Pb, Pc and Pd is fed to the fixing device 7 from the left side of the belt 8. The transfer material 6 having been subjected to the image fixing operation is discharged to the outside of the main assembly 10 through the discharging outlet 14.

The first, second, third and fourth image forming stations Pa, Pb, Pc and Pd which are juxtaposed above the conveying means, have respective photosensitive drums 1*a*, 1*b*, 1*c* and 1*d*. To the upper left portion of each of the photosensitive drums 1*a*, 1*b*, 1*c* and 1*d*, a charger 15*a*, 15*b*, 15*c* or 15*d* is disposed. Above each of the photosensitive drums 1*a*, 1*b*, 1*c* and 1*d*, a laser beam scanner 16*a*, 16*b*, 16*c* or 16*d* is disposed. Each of the scanners includes a semiconductor laser, a polygonal mirror and an f-$\theta$ lens. It receives an electric digital image signal corresponding to an original image, and scans the photosensitive drum with a laser beam modulated in accordance with the signal in a direction of a generating line of the associated photosensitive drum at a position between the charger 15*a*, 15*b*, 15*c* or 15*d* and the developing device 3*a*, 3*b*, 3*c* or 3*d*. By the scanning exposure, a latent image is formed on the photosensitive drum. More particularly, the laser scanner 16*a* of the first image forming station Pa receives a picture element signal corresponding to the yellow color component image of a color original; the laser scanner unit 16*b* of the second image forming station Pb receives a picture element signal corresponding to the magenta color component thereof; the laser scanner 16*c* of the third image forming station Pc receives the picture element signal corresponding to the cyan color component image thereof; and the laser scanner 16*d* of the fourth image forming station Pd receives the picture element signal corresponding to the black color component thereof.

The sheet feeding mechanism 13 is provided with a sheet feeding guide 51 and a sensor 52. When the transfer material is inserted to the sheet guide 51, the leading edge thereof is detected by the sensor 52. In response to the detection, a signal is transmitted to the photosensitive drums 1*a*, 1*b*, 1*c* and 1*d* to start the rotation. Simultaneously, the driving rollers 11, 12 and 76 are driven, by which the belt 8 is rotated. The transfer material 6 supplied to the belt 8 is subjected to the corona discharge from attraction chargers 59 and 62, by which the transfer material 6 is assuredly attracted on the surface of the belt 8. In this embodiment, the polarities of the high voltage for the attraction chargers 59 and 62 are different from each other, and the charging polarity of the charger 62 is the same as the charging polarity of the transfer chargers 4*a*, 4*b*, 4*c* and 4*d*.

When the leading edge of the transfer material 6 is detected by the sensor 60*a*, 60*b*, 60*c* or 60*d*, an image forming operation is started on the photosensitive drum 1*a*, 1*b*, 1*c* or 1*d* corresponding to the sensor. After the transfer material 6 passes through the fourth image forming station Pd, an AC voltage is applied to the discharger 61, by which the transfer material 6 is electrically discharged, so that the transfer material 6 is separated from the belt 8. Thereafter, the transfer material 6 is conveyed to the image fixing device 7 where the toner image on the transfer material 6 is fixed. The transfer material is discharged through the discharge outlet 14.

The material of the belt 8 (dielectric material having a volume resistivity of not less than $10^{16}$ ohm.cm) in this embodiment is, for example, polyurethane (Hokushin Kogyo Kabushiki Kaisha, Japan) having a small elongation, and having high efficiency of drive transmission for the driving roller. Structurally, it is desirable that the transfer corona current in the transfer process is not significantly influenced. The polyurethane belt has, for example, a thickness of approximately 100 microns, a rubber hardness of 97 degrees D, and tension elasticity of 16000 kg/cm$^2$.

Figure 1:
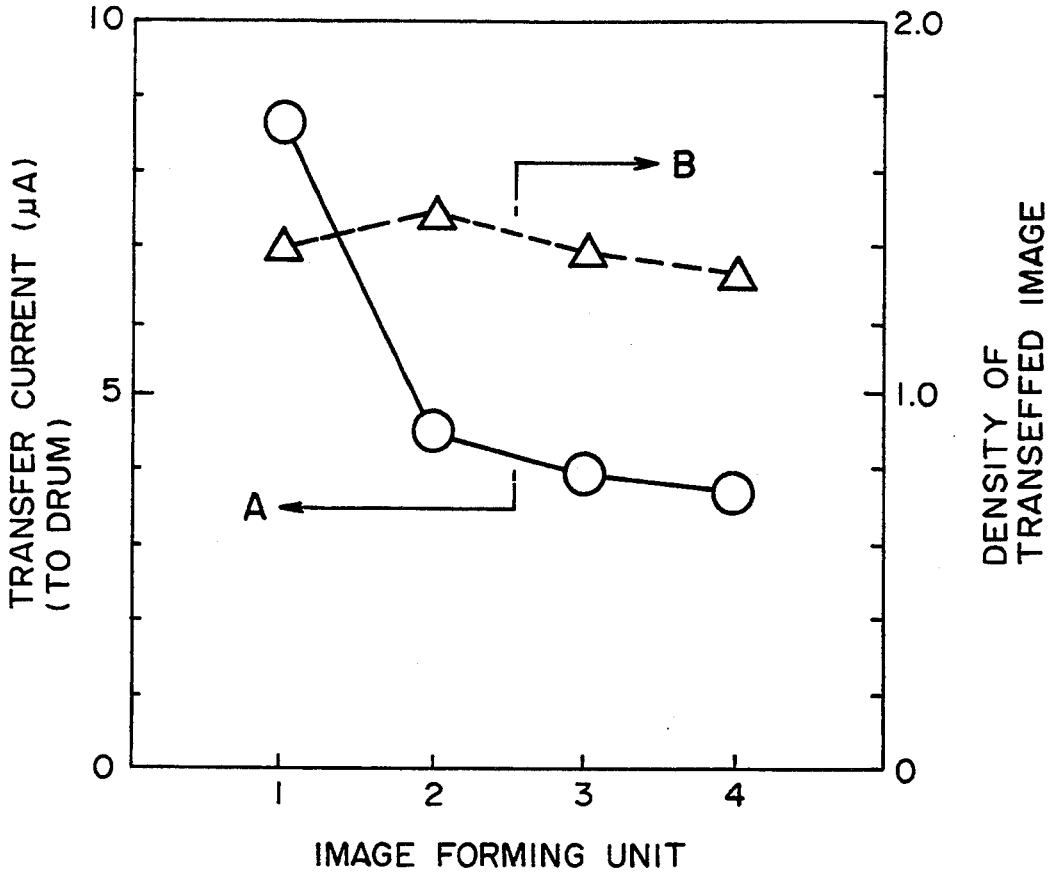
FIG. 1 is a graph showing the relation between a maximum image density and the transfer current through the photosensitive drum in each of the image forming stations, in a device according to an embodiment of the present invention.
Figure 2:
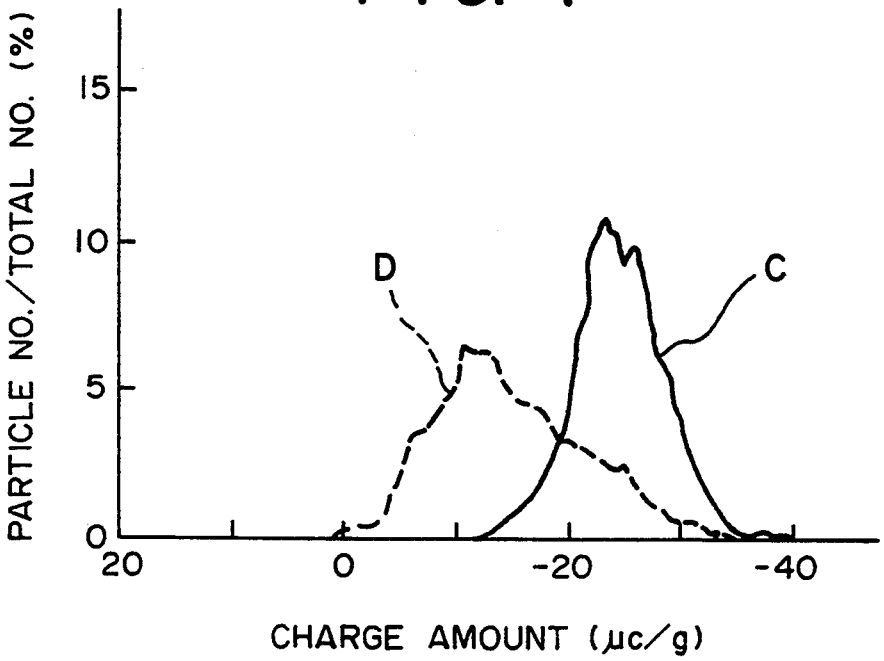
FIG. 2 is a graph illustrating the distribution of the charge amount of the toner particles.

The experiments have been carried out to quantatively know the image transfer parameters in each of the image transfer stations. The results of experiments are shown in FIGS. 1 and 2. The image transfer currents to each of the photosensitive drums is measured. First, when the image transfer conditions in each of the image forming stations are made the same, using the belt 8, the results are as shown in FIG. 1, A. More specifically, the transfer conditions are such that the total transfer current is 450 micro-ampere, that the distance between the drum and the discharge wire of the transfer charger is 11 mm and that the distance between the transfer discharging wire and the back-up electrode plate is 8.5 mm. The upper and lower attraction chargers 59 and 62 operable prior to the image transfer operation, have the same configuration as the image transfer chargers 4*a*–4*d*. The total currents are 200 micro-ampere, and the distances between the discharging wires and the conveying belt are 11 mm, in the upper and lower attraction chargers.

As will be understood from the results of measurements (FIG. 1), the transfer current gradually decreases with the passages of the transfer material 6 through the image forming units. This is because the amount of electric charge on the belt 8 (dielectric sheet) is increased by the image transfer actions.

The inventor has adjusted the respective color developers to the respective toner supplying portion so that the average charge amounts of the respective color developers decreases with the process of the image transfer action. As will be understood from FIG. 1, the difference in the transfer current is extremely large between the first image forming station and the second image forming station, than between the other image forming stations. Therefore, the average charge amount of the toner of the developer used in the first image forming station is made larger than in the other image forming stations.

The reason will be described. When, for example, the transfer bias applies 5 (amount assumed for the purpose of easy explanation) electric charges onto the backside of the transfer material, the toner corresponding to the 5 electric charges are attracted to the transfer material. The toner image density on the transfer material is higher when both of a toner particle having 2 electric charges and a toner particle having 3 electric charges are attracted to the transfer material than when a toner particle having 5 charges is attracted to the transfer material. Therefore, even if the transfer current decreases, the same image density as in the case of no reduction of the transfer current can be provided by changing the amount of charge of the toner, even if the transfer current is reduced. In order to provide such a large average charge amount, the particle size of the toner is reduced in this embodiment. More specifically, the average particle size (number average) of the toner used in the first image forming station is approximately 9 microns, whereas the average particle sizes of the other image forming stations are approximately 12 microns.

As for the carrier particles contained in the developer, ordinarily used carrier is used, the ferrite magnetic particles having an average particle size of 50 microns each coated with silicone resin.

The charge amount distributions of the two kinds of toner particles are shown in FIG. 2. The measurement thereof is a conventional one wherein the number of distributed toner particles falling through an electric field are counted.

FIG. 2 shows the charge amount distribution of the toner having the average particle size of 9 microns and the toner charge amount distribution of the toner particles having the average particle size of 12 microns (the charge amount distribution of the toner in the third and fourth image forming stations are the same as that of 12 micron toner). The respective average charge amounts are approximately 27 micro-coulomb/g for 9 micron toner and 14 micro-coulomb/g for 12 micron toner. Thus, by changing the toner particle size, the contact area between the toner particles and carrier particles are changed, so that the amount of triboelectric charge is changed. More particularly, when the particle size of the toner is reduced, the contact area between the toner particles and carrier particles is increased, so that the average charge amount is increased, whereas when the toner particle size is increased, the contact area therebetween is reduced, so that the average charge amount is reduced.

When the respective color toner images are overlaid and are fixed on the transfer material with the average toner particle size of 9 microns in the first image forming station and with the average toner particle size of 12 microns in the other stations, the maximum image densities in each of the colors are measured. The results are shown in FIG. 1. As will be apparent from this Figure, substantially the same image densities are provided for the respective colors.

In this embodiment, as described above, the particle size of the toner in the respective toner supplying portions are made larger in the order of the transfer operations so that the average charge amounts of the toner particles sequentially transferred decrease in the order.

In this embodiment, the toner particle size is reduced only for the first image forming station where the average charge amount is significantly different when the same particle size is used, and the same larger particle size is used for all of the rest of the image forming stations. Depending on the variation in the transfer currents, however, the toner particle size may be changed to control the amount of the electric charge for one or more of the rest of the image forming stations.

In this embodiment, the amount of the average charge is controlled by controlling the toner particle size. However, the amount of the electric charge on the respective toners may be controlled by changing the resin coating on the surface of the carrier particles in the developer.

As to the resin coating, U.S. Pat. No. 4,562,136 (Japanese Patent Application Publication No. 619478/1987) discloses one. In this method, the ratio of uncured component of the coating resin on the carrier surface is changed to change the amount of charge on the toner. More particularly, normal temperature curing silicone resin is used, and by changing the sintering temperature and period, the weight percentage of the uncured component is controlled. The experiments show that when the percentage of the uncured component is 10% by weight, the average charge amount of the toner is −20 microcoulomb/g; and when the uncured component ratio is 25% by weight, the charge amount is −10 microcoulomb/g.

The uncured component content of the carrier coating film can be determined by measuring the amount of solution dissolved in the solvent, or by calculating the total amount of the silicone resin in the coating by true specific gravity method. It is desirable that the carrier and toner have the same particle sizes as with the foregoing embodiment.

The carrier particles having a smaller uncured component content (10% by weight) is used with the toner particles used in the first part or parts of the image transfer operations, whereas the carrier particles having a larger uncured component content (25% by weight) are used in the latter part or parts thereof. By doing so, the same results can be obtained as in the foregoing embodiment in which the toner particle sizes are made different.

Alternatively, the average charge amount of the toner particles can be adjusted using both methods in combination.

In the foregoing embodiments, each of the image forming stations Pa, Pb, Pc and Pd is provided with an independent photosensitive drum, and the transfer material 6 is conveyed by the conveyer belt 8. It is a possible alternative that a common photosensitive drum is used for the image forming stations Pa, Pb, Pc and Pd, and the latent image formations and the developing operations for each colors are performed in a time-shared manner, sequentially, and that a transfer drum is used in place of the conveyer belt for conveying the transfer material 6. As for the developing means, it is possible that plural developing means are operated in a common developing position. The present invention is applicable to such types of image forming apparatus.

In addition, the present invention is applicable to an apparatus wherein an intermediate transfer material is used, and the toner images are transferred directly onto a conveyer belt (dielectric member) functioning as an image receiving member in place of the transfer material, and the superposedly transferred images on the conveyer belt are transferred onto the transfer material at once.

The present invention is particularly advantageous when it is used with an apparatus wherein a latent image on the photosensitive drum is developed with the toner having been charged to the same polarity as the charging polarity of the latent image (reverse-development). The reason is that in the case of the reverse-development, the toner particles are deposited on the portion of the photosensitive drum which have been exposed to the light, and therefore, the toner attraction force to the photosensitive drum is smaller than in the regular development case. Therefore, the toner particles are easily transferred.

As described in the foregoing, according to the present invention, the average charge amount of the toner particles is reduced with the processing of the transfer operation, and therefore, the toner transfer actions of the respective colors are made uniform even if the charge amount of the charging means is increased with the processing of the transfer operation. Therefore, the same image density can be provided, and therefore, high quality images can be provided without reduction of the attraction force of the transfer material on the conveying belt. In addition, the uniformity of the transfer actions can be achieved without changing the transfer conditions in the respective image forming stations, and therefore, no additional part is required, and the cost of the apparatus is not increased.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

image bearing means;

means for forming latent images on said image bearing means;

a plurality of developing means for developing the latent images formed by said image forming means with different color toner particles into toner images, each of said plurality of developing means includes a developer containing said different color toner particles and carrier particles;

an image receiving material carrying means for carrying an image receiving material thereon; and transfer means for sequentially effecting image transfer operations for respective colors to transfer electrostatically the different color toner images from said image bearing means to the same image receiving material carried on said image receiving material carrying means wherein the image receiving material carried on said image receiving material carrying means is subjected to the image transfer operation of said transfer means a plurality of times;

wherein the carrier particles used with the toner particles transferred in the initial stage or stages of the sequential image transfer operations are coated with surface coating resin having an uncured component content less than the carrier particles used with the toner particles in the later stage or stages of the sequential image transfer operations so as to control an average charge amount of the toner particles.

2. An apparatus according to claim 1, wherein the average charge amount of the toner particles is decreased with processing of the sequential image transfer operations.

3. An apparatus according to claim 1, wherein said carrying means includes a dielectric member for carrying the image receiving material.

4. An apparatus according to claim 1, 2 or 3, wherein said transfer means has corona discharging means.

5. An apparatus according to claim 3, wherein said conveying means electrostatically attracts the transfer material.

6. An apparatus according to claim 1 or 3, wherein said transfer means has a plurality of transfer stations at different positions relative to said carrying means.

7. An apparatus according to claim 6, wherein each of the transfer stations includes respective image bearing means and respective image transfer means.

8. An apparatus according to claim 7, wherein the respective image transfer means have substantially the same image transfer conditions.

9. An apparatus according to claim 8, wherein the respective image transfer means all have the same total currents.

10. An apparatus according to claim 3, wherein plural toner images are superposedly transferred from said image bearing means to the same image receiving material.

11. An apparatus according to claim 10, wherein said apparatus is a full-color image forming apparatus.

12. An apparatus according to claim 3, wherein said transfer means is opposed to said image bearing member through the dielectric member.

13. An apparatus according to claim 1, wherein an average charge amount of the toner particles per unit weight thereof at an initial stage or stages of the sequential image transfer operations is larger than an average charge amount of the toner particles per unit weight thereof at a later stage or stages of the sequential image transfer operations, and wherein the average charge amount of the toner particles at said later stage does not exceed the average charge amount of the immediately preceding stage.

14. An apparatus according to claim 1, wherein said developing means contains the toner particles charged to a polarity which is the same as a charging polarity of the latent image.

15. An apparatus according to claim 1, wherein the average change amount at the initial stage is larger than that at any later stage.

16. An apparatus according to claim 1, wherein four different color toners including a black toner, are used, and in the case the four color toners are transferred on a same image receiving material, the black toner is transferred last.

17. An image forming apparatus, comprising:

image bearing means;

means for forming latent images on said image bearing means;

a plurality of developing means for developing the latent images formed by said image forming means with different color toner particles, having respective average charge amounts per unit weight, into toner images;

an image receiving material carrying means for carrying an image receiving material thereon; and means for sequentially effecting image transfer operations for respective colors by transferring electrostatically the different color toner images from said image bearing means to the same image receiving material carried on said image receiving material carrying means;

wherein said average charge amounts of the toner particles are set throughout the image transfer operations for the same image receiving material whereby a charge amount of said image receiving material carrying means in one of the image transfer operations for the same image receiving material is larger than a charge amount in another of the image transfer operations for the same image receiving material if the average charge amount of the toner particles to be transferred in said one of the image transfer operations is smaller than a charge amount in said another image transfer operations.

18. An apparatus according to claim 17, wherein the average charge amount of the toner particles is decreased with processing of the sequential image transfer operations.

19. An apparatus according to claim 17, wherein said carrying means includes a dielectric member for carrying the image receiving material.

20. An apparatus according to claim 19, wherein said carrying means electrostatically attracts the transfer material.

21. An apparatus according to claim 17, wherein said transfer means has a plurality of transfer stations at different positions relative to said carrying means.

22. An apparatus according to claim 21, wherein each of the transfer stations includes respective image bearing means and respective image transfer means.

23. An apparatus according to claim 17, wherein the image receiving material carried on said image receiving material carrying means is subjected to the image transfer operation of said transfer means a plurality of times.

24. An apparatus according to claim 23, wherein an average charge amount of the toner particles per unit weight thereof at an initial stage or stages of the sequential image transfer operations is larger than an average charge amount of the toner particles per unit weight thereof at a later stage or stages of the sequential image transfer operations, and wherein the average charge amount of the toner particles at said later stage does not exceed the average charge amount of the immediately preceding stage.

25. An apparatus according to claim 18, wherein an average charge amount of the toner particles per unit weight thereof at an initial stage or stages of the sequential image transfer operations is larger than an average charge amount of the toner particles per unit weight thereof at a later stage or stages of the sequential image transfer operations, and wherein the average charge amount of the toner particles at said later stage does not exceed the average charge amount of the immediately preceding stage.

26. An apparatus according to claim 23, wherein said apparatus is a full-color image forming apparatus.

27. An apparatus according to claim 17, wherein each of said plurality of developing means includes a developer containing toner particles and carrier particles.

28. An apparatus according to claim 27, wherein the carrier particles used with the toner particles transferred in the initial stage or stages are coated with surface coating resin having an uncured component content less than the carrier particles used with the toner particles in the later stage or stages.

29. An apparatus according to claim 17, wherein the respective image transfer means all have the same total currents.

30. An apparatus according to claim 17, wherein four different color toners including a black toner, are used, and in the case the four color toners are transferred on a same image receiving material, the black toner is transferred last.

* * * * *

UNITED STATES PATENT AND TRADEMARK OFFICE

CERTIFICATE OF CORRECTION

PATENT NO. : 5,363,178

DATED : November 8, 1994

INVENTOR(S) : Kenichi Matsumoto

It is certified that error appears in the above-identified patent and that said Letters Patent is hereby corrected as shown below:

ON THE COVER

Under [56] References Cited, Foreign Patent Documents, "0082263 5/1983 Japan" should read -- 58-082263 5/1983 Japan--; and Under [57] Abstract, "with" should read --for--.

IN THE DRAWINGS

Sheet 1, Figure 1, "TRANSEFFED" should read --TRANSFERRED--.

COLUMN 2

Line 23, "contactness" should read --contact--.

COLUMN 8

Line 18, "conveying" should read --carrying--.

Signed and Sealed this

Eleventh Day of April, 1995

Bruce Lehman

*Attest:*

BRUCE LEHMAN

*Attesting Officer*

*Commissioner of Patents and Trademarks*